US009532130B2

(12) United States Patent
Fargeau et al.

(10) Patent No.: US 9,532,130 B2
(45) Date of Patent: Dec. 27, 2016

(54) AUDIO HEADSET

(71) Applicant: PARROT, Paris (FR)

(72) Inventors: Karim Fargeau, Charenton le Pont (FR); Margot Pëjaudier, Paris (FR)

(73) Assignee: Parrot Drones, Paris (FR)

( * ) Notice: Subject to any disclaimer, the term of this patent is extended or adjusted under 35 U.S.C. 154(b) by 0 days.

(21) Appl. No.: 14/956,473

(22) Filed: Dec. 2, 2015

(65) Prior Publication Data

US 2016/0173968 A1 Jun. 16, 2016

(30) Foreign Application Priority Data

Dec. 10, 2014 (FR) ..... 14 62174

(51) Int. Cl.

| | |
|---|---|
| ***H04R 25/00*** | (2006.01) |
| ***H04R 1/10*** | (2006.01) |
| ***H04R 5/033*** | (2006.01) |
| ***H04R 1/04*** | (2006.01) |

(52) U.S. Cl.

CPC ..... *H04R 1/105* (2013.01); *H04R 1/04* (2013.01); *H04R 1/1016* (2013.01); *H04R 1/1058* (2013.01); *H04R 5/0335* (2013.01); *H04R 1/1066* (2013.01); *H04R 2201/105* (2013.01); *H04R 2201/107* (2013.01); *H04R 2201/109* (2013.01)

(58) Field of Classification Search

CPC ..... H04R 1/10; H04R 1/1008; H04R 1/1016; H04R 1/105; H04R 1/1058; H04R 1/1066; H04R 5/033; H04R 5/0335; H04R 2201/105; H04R 2201/107; H04R 2201/109; H04M 1/05

USPC ..... 381/309, 72, 370, 374, 375, 376, 377,381/378, 379, 380, 383; 181/129, 130, 135; 2/209; 379/430

See application file for complete search history.

(56) References Cited

U.S. PATENT DOCUMENTS

| | | | | |
|---|---|---|---|---|
| 4,404,434 A * | 9/1983 | Pelt | ..... | H04R 5/0335 2/209 |
| 4,463,223 A * | 7/1984 | Yamanoi | ..... | H04R 5/0335 2/209 |
| 4,551,584 A | 11/1985 | Mathiasen | | |
| D469,081 S | 1/2003 | Perszyk et al. | | |

(Continued)

FOREIGN PATENT DOCUMENTS

EP 2597889 A1 5/2013

OTHER PUBLICATIONS

Gasior, The sweet sound of Koss' PortaPro headphones, The Tech Report—Technological Dissonance (Jul. 15, 2010).

(Continued)

*Primary Examiner* — Huyen D Le

(74) *Attorney, Agent, or Firm* — Marshall, Gerstein & Borun LLP

(57) ABSTRACT

This headset has two earphones adapted to be introduced inside or near to the auditory canal of the user. The earphones are connected by a connection element that has a central band resting on the top of the headset user's head, and two lateral branches extending the band. Each of the bands has, at a proximal end, an articulated connection with the central band; at a distal end, a deformable connection with the respective earphone; and, in a median region, a case that houses electric or electronic components. An internal side of the case, which is directed towards the user's head, has a bearing face that is adapted to come into contact with a temporal region of the headset user.

11 Claims, 3 Drawing Sheets

(56) References Cited

U.S. PATENT DOCUMENTS

| | | | | |
|---|---|---|---|---|
| 8,233,655 | B2 * | 7/2012 | Miyata | H04R 5/0335 381/370 |
| 8,948,409 | B2 | 2/2015 | Hua | |
| 2014/0010389 | A1 * | 1/2014 | Slocum | H04R 1/1066 381/309 |
| 2014/0205108 | A1 | 7/2014 | Triato | |

OTHER PUBLICATIONS

Lai, Parrot Zik Sport headphones do noise canceling, heart monitoring, Engadget (Jan. 4, 2015).
Preliminary Search Report, French patent application No. FR1462174, dated Oct. 1, 2015.
Sony Electronics Inc., Sony MDR-A35G, S2 Sports vertical, in-ear headphones (copyright 2004; last updated Aug. 21, 2009).
Zafra, JVC announces new bi-metal slim headphones, Technology Tell (Apr. 3, 2008).

* cited by examiner

AUDIO HEADSET

BACKGROUND

The invention relates to the audio headsets, in particular models that are adapted for use while engaging in physical activity.

An audio headset comprises two earphones connected by a connection element that is positioned around the head of the headset user, passing either above the head or behind the head (hence surrounding the occipital region).

Such a type of headset is described in detail in the article by Geoff Gasior "The Sweet Sound of Koss' PortaPro Headphones", The Tech Report—Technological Dissonance, 15 Jul. 2010, XP055203885. The band of this headset includes articulated branches that allow the headset to be stored in a compact folded form. The band includes pads that are intended to rest on the temporal region, absorbing some of the clamping force of the metal blade of the band and to hence prevent discomfort arising from an excessive resting force of the earphone on the upper part of the wearer's ear auricle.

During exercise, a main difficulty is holding the headset in the correct position on the user's head while user moves, jumps, or otherwise encounters repeated stresses during the exercise.

This problem becomes particularly critical if it is desired to provide the headset with a wireless link (of the Bluetooth type or the like) and/or with digital processing circuits such as a circuit for the active reduction of the ambient noise (ANC, Active Noise Control), a biometric data detection and processing circuit, etc. The headset must then support not only the acoustic transducers, but also one or several printed circuit boards carrying the active and passive components, as well as sensors (microphones, accelerometers, etc.) and of course a rechargeable battery or a cell for powering these various circuits and sensors, as well as a suitable connection arrangement.

These elements increase the weight and the volume of the headset and make it more difficult to keep the headset in the proper position on the user's head.

That's why, for exercise, users often choose intra-aural (or intra-concha) earphones, which stay in place in place better on the ear, and are both light and comfortable.

If it is desired to provide such intra-aural earphones with additional circuits, for example wireless link circuits, those elements are usually housed in an extended case that protrudes out of the ear's auricle, as the old-generation hearing aids of the "behind-the-ear" type.

Such a solution is described for example in US 2014/0307891 A1, which provides two intra-aural earphones each associated with a "behind-the-ear" case, the two right and left cases being mechanically and electrically connected by a pendant cable.

The case associated with an intra-aural earphone may possibly be extended towards the mouth if it is desired to use it to house a microphone for communication functions (in particular "hands-free" telephony), as described for example in US D469081 S.

But the set becomes heavy and uncomfortable, preventing an extended use during exercise.

Another solution, described for example in US 2014/0205108 A1, consists of offsetting the electronic circuits and the battery to a case worn around the user's neck. There is no longer a holding or comfort problem at the earphones, but an offset case can produce discomfort when, for example, the user runs, and to avoid that discomfort hampering a runner, it is necessary to use a clamp, an armband, or another holding means.

Those difficulties are even more constraining if it is desired to provide the headset not only with wireless communication circuits, but also with ANC circuits for the active reduction of the ambient noise. Those circuits are bulky and heavy, and require a far more powerful battery to ensure an autonomy, even of a few hours, taking into account the consumption of the digital processor(s) implemented by those circuits.

That is why ANC headsets are practically always headsets of the circumaural or supra-aural type (i.e. with a trimming fully surrounding the ear, or placed on the contour of the ear's auricle), as described for example in EP 2 597 889 A1 (Parrot).

Those headsets are not well adapted to use during exercise due to the volume and the mass of the earphones, and are not designed to hold the headset securely enough on the user's head to resist to the various movements produced during exercise. Moreover, even in absence of sudden stresses, the lack of aeration of the ear's auricle causes earphones applied against the ear or about the ear to rapidly become uncomfortable during exercise and/or in case of heat or extended wearing.

Consequently, intra-aural earphones are the only type of headset that can be practically used during exercise.

Hence, one problem addressed by the inventors was to adapt intra-aural or intra-concha earphones (that have proven themselves with sportsmen/women in terms of comfort and holding) with electronic circuits, even bulky and heavy ones, as well as the cells or batteries required to power those three elements, while preserving comfort and stability of the headset on the user's head.

The constraints of acceptability in intensive and extended sport activity are in particular the following:

- a structure that is light enough to be supportable during sports with no discomfort for the user;
- a structure that easily adapts to the individual head morphology of each user;
- a structure that assures excellent comfort, even in case of extended wearing and with the exercise of a physical activity; and
- a structure that efficiently holds the headset in place on the user's head and provides good stability of the headset, particularly during sports activity.

The invention proposes for that purpose an audio headset that comprises, in a manner known per se, two earphones of the intra-aural or intra-concha type, adapted to be introduced inside or near to a respective auditory canal of the headset user, a case housing electric or electronic components, and a connection element adapted to be positioned around the head of a user of the headset.

Characteristically of the invention, the connection element comprises a central band adapted to rest on the top of the user's head, forming a first point of contact with the user's head, as well as two lateral branches extending the central band at each of its ends. Each of these branches comprises: at a proximal end of the branch, an articulated connection with the respective end of the central band, this connection providing at least one pivotal degree of freedom about an axis perpendicular to the general plan of the headset; at a distal end of the branch, a deformable connection with the respective earphone, so that the earphones form at the auditory canal respective second and third points of contact; and, in a median region of the branch, the case housing the electric or electronic components, this case being provided, at an internal side of the headset that is directed towards the user's head, with a bearing face that is adapted to come into contact with a temporal region of the headset user, so that the bearing faces form at the temples respective fourth and fifth points of contact.

According to various advantageous subsidiary characteristics:

the bearing face is a planar face provided with a soft trimming;

the central band is a flexible band, elastically deformable according to at least one flexural degree of freedom in the general plan of the headset;

the degree of freedom offered by the articulated connection of the branch to the central band has a sufficient angular displacement to allow a complete folding of the branch against the central band, with the branches and cases essentially located on a same side of a line joining the two articulated connections, in particular with the case located on the side of the most proximal part of the median region of the branch;

the case is a case that is distinct of the median region of the branch, and fastened to the latter on the internal side of the branch;

the branch further comprises a telescopic element for size adjustment, adapted to modify the distance separating the central band from the earphone, with in particular this telescopic element located near to said connection of the branch to the central band;

the articulated connection of the branch to the central band includes a spring clamping element, adapted to elastically push the branch towards the internal side of the headset, in a direction oriented towards the user's temple;

the headset comprises at least one microphone incorporated into a branch in the median region thereof, and a connector incorporated into a branch with a receptacle opening at the distal end of the branch, the axis of this receptacle being in the continuation of the general direction of the branch.

BRIEF DESCRIPTION OF THE DRAWINGS

An example of one embodiment of the invention will now be described, with reference to the appended drawings in which the same references denote identical or functionally similar elements throughout the figures.

DETAILED DESCRIPTION

Figure 1:
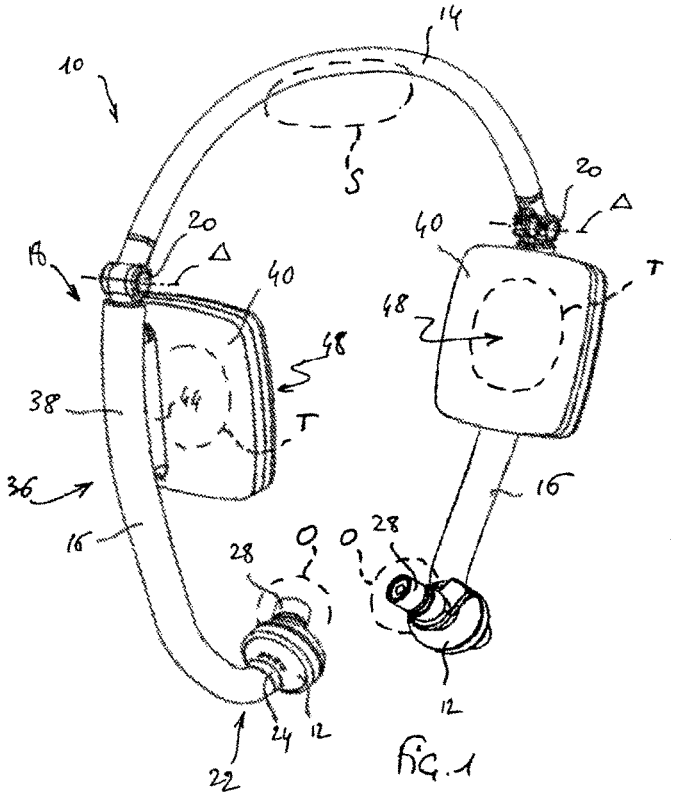
FIG. 1 is a perspective view of an exemplary embodiment of the headset according to the invention.
Figure 2:
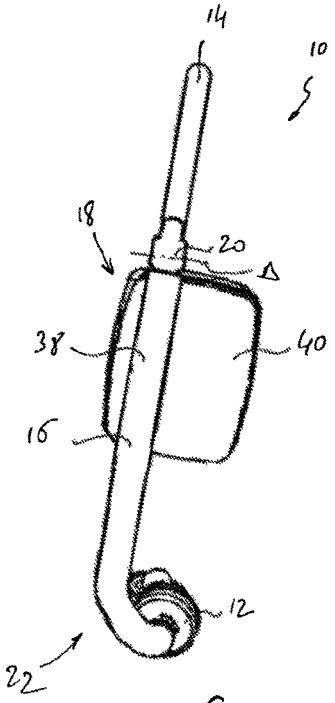
FIG. 2 is a side view of the headset of FIG. 1.

In the figures, the reference 10 generally denotes an exemplary embodiment of a headset according to the invention, which includes two earphones 12 that are connected to each other by a connection element comprising a central band 14 and two branches 16.

The earphones 12 are of a known type, referred to as "intra-aural" (as in the example illustrated in the figures) or "intra-concha". Intra-aural earphones are those that include a tube penetrating into the auditory canal, this tube ensuring the mechanical holding of the earphone on the ear, whereas intra-concha earphones are intended to be placed in the region of the central depression (lower concha) of the external ear located at the opening of the auditory canal.

The two branches 16, with their earphones 12, are similar and symmetrical to each other. Each one includes at its proximal end 18 a connection 20 articulated to the central band 14. This articulated connection 20 provides at least one pivotal degree of freedom about an axis Δ perpendicular to the general plan of the headset. Moreover, it advantageously includes a spring clamping element that elastically pushes the branch 16 towards the internal side of the headset so as to push this branch, and hence the earphone 12, towards the user's temple and ear, to improve the coupling of the earphone to the ear.

Figure 6:
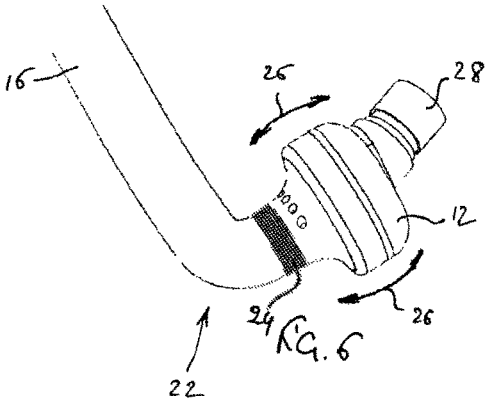
FIG. 6 is a magnified detail view of the connection of the end of the headset lateral branch to the earphone supported by this end.

On the distal side 22, the branch 16 is connected to the earphone 22 by a deformable connection 24, for example (see FIG. 6) an over-molding of soft material between the end of the branch 16 and the base of the earphone 12, so as to make the earphone 12 mobile (arrows 26) with respect to the branch and to facilitate the introduction and the holding of the protruding tip 28 of the earphone into the auditory canal. It will be noted that the invention is preferably implemented with earphones 12 of the intra-aural type, which provide an increased isolation with respect to the ambient noises due to the protruding tip 28 introduced into the auditory canal. This tip 28 is moreover provided with a deformable part (not illustrated), made of silicone or foam, for example, to ensure a better coupling with the ear and hence a better passive isolation.

Figure 3:
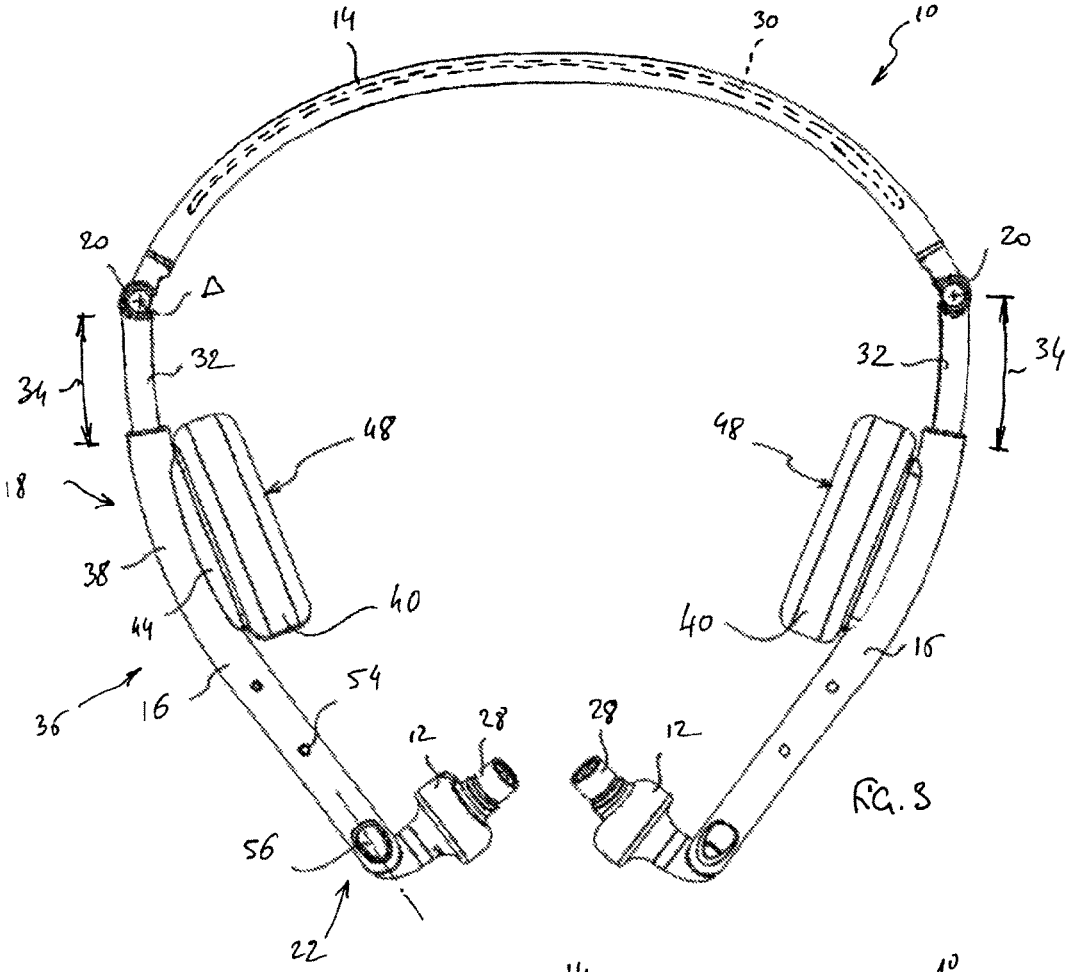
FIGS. 3 and 4 are front views of the headset of FIG. 1, in extended position, before the positioning on the user's head, and in folded position, for the storing and the transportation, respectively.

The central band 14 is deformable in flexion, i.e. by remaining in the general plan of the headset (the plan of the figure in the case of FIG. 3), for example by use of an elastic metal plate 30 embedded in the material of the central band 14. This flexibility enables the headset to be easily adapted to most of the skull diameters liable to be met.

To also facilitate adaptation to the morphology of different users, a telescopic element 32 is provided near to the articulated connection 20. This element enables the distance (denoted 34 in FIG. 3) separating the articulated connection 20 from the earphone 12 to be varied, typically up to a maximum extension of 40 mm, so as to fit most of the skull heights liable to be met.

The median region 36 of the branch 16 supports a case 40 fulfilling several functions that will be explained hereinafter.

Advantageously, the case 40 is located in the most proximal part 38 of the median region 36. In particular, this enables the headset to fold over itself for storage and transportation.

Figure 4:
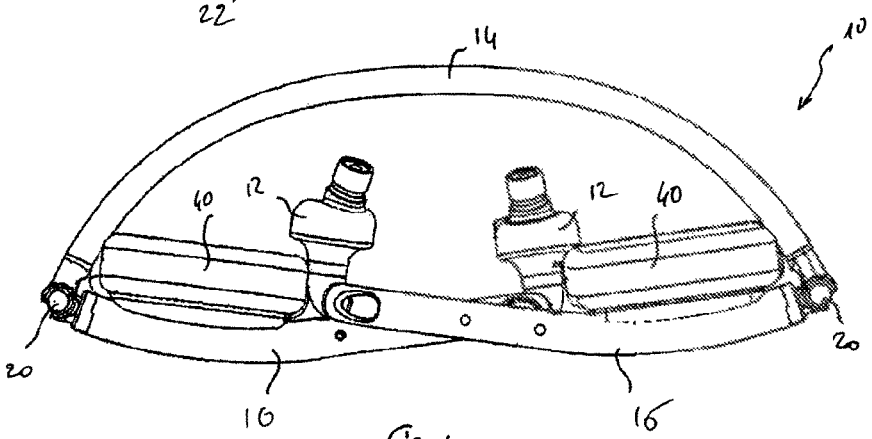

This folded position is illustrated in particular in FIG. 4: the telescopic elements 32 have been placed in a position of minimum extension, and there remains enough room between the two cases 40 so that the two earphones 12 can be positioned there. In this completely folded position, all the bulky elements of the headset, mainly the two cases 40 and the two earphones 12 are essentially located on a same side of a line joining the two articulated connections 20 on either side of the central band 14, hence ensuring a maximum compactness.

Figure 5:
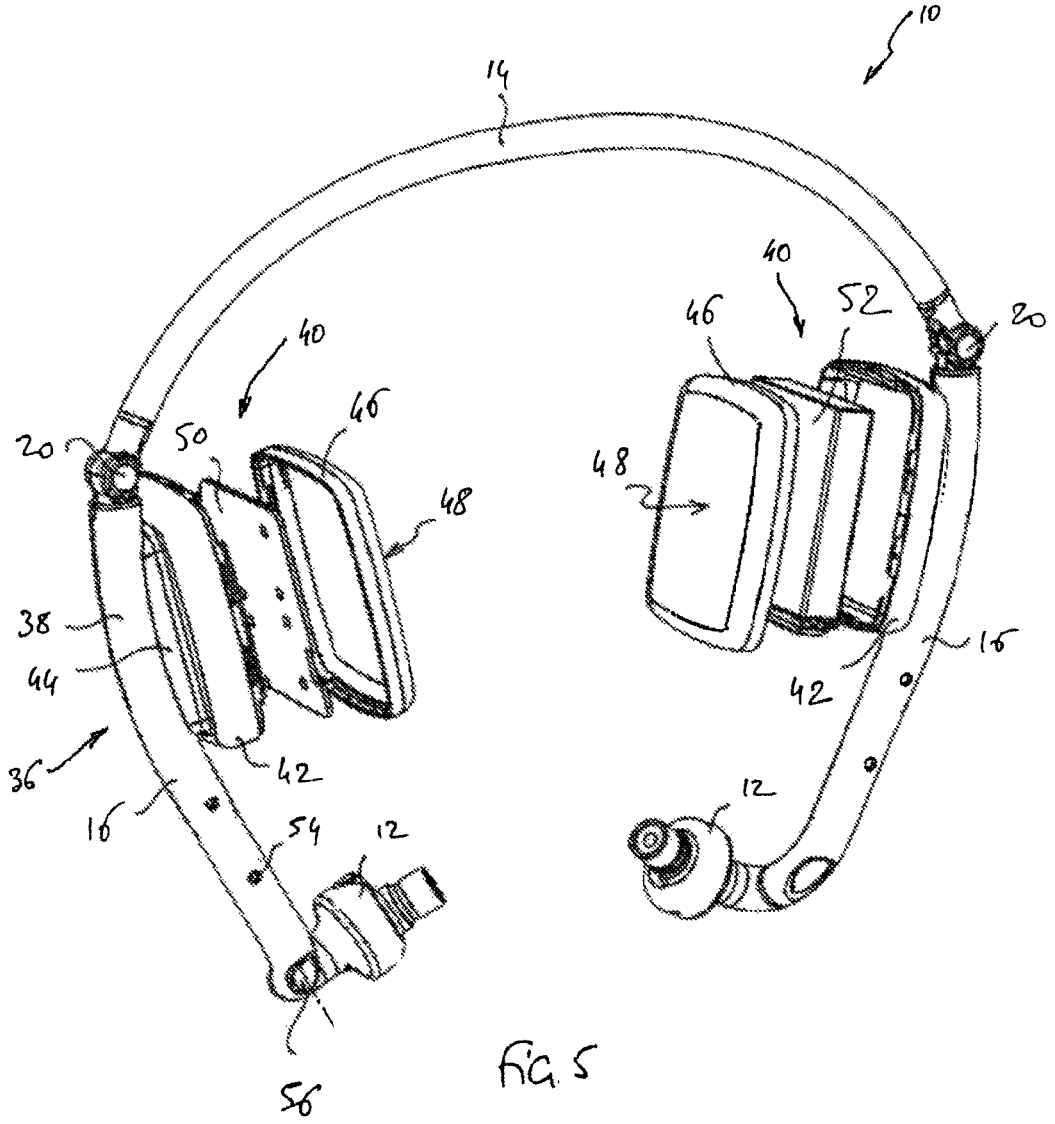
FIG. 5 is an exploded perspective view showing the content of the cases containing the electronic circuits and the battery.

As illustrated in particular in FIG. 5, each case 40 has a body 42 that is connected to the branch 16 by an element 44, and the case 40 slightly protrudes towards the internal side of the headset, towards the user's temple. As a variant, a thicker branch including the case 40 as a more integrated form could alternatively be used.

The body 42 is closed by a lid 46 that is provided with a trimming forming a bearing face 48, for example a foam trimming that fulfills a triple function:

better contact with the user's head, deformation of the foam enabling it to conform to the profile of the user's temple;

good comfort for headset-temple contact; and resistance to sliding, for better stability, in particular against sudden movements during the sports.

The cases 40 contain various electric and electronic elements, for example one or several printed circuit boards 50 in one of the cases, and a rechargeable battery 52 in the other case, the two cases being connected via an electric connection (not shown) running through the central band 30.

The electronic circuits 50 may possibly be connected to various sensors and/or electric members supported by the branches 16, for example one or several microphone sensors 54 (for "hands-free" telephony functions and/or ANC functions by ambient noise level picking-up), or an electric connector with a receptacle 56 opening at the end of the branch with its axis in the continuation of the general direction of the branch.

The intent of the headset configuration that has just been described is to have five points of contact with the user's head, i.e., as illustrated in FIG. 1:

a point S where the central band 14 is in contact with the top of the skull;

two points T where the bearing faces 48 of the cases 40 are in contact with the lateral parts of the skull, in the temporal or parieto-temporal region; and two points O where the earphones 12 are in contact with the auditory canal in which the tip 28 has been inserted.

It is hence obtained, characteristically of the invention, a holding of the "head-temple-ear" type, which both: i) helps stabilize the headset, in particular during sport activity, and ii) ensures a very good comfort, even during an extended wearing and/or in a relatively high-temperature environment, because the ear's auricle and the major part of the user's head (with the limited exception of five contact points) remain aerated and ventilated to allow in particular the evaporation of sweat.

The invention claimed is:

1. An audio headset, comprising:

two earphones of the intra-aural or intra-concha type, adapted to be introduced inside or near to a respective auditory canal of the headset user;

a case housing electric or electronic components; and a connection element adapted to be positioned around the head of a user of the headset, characterized in that the connection element comprises:

a central band adapted to come in rest on the top of the headset user's head so as to form thereon a first contact point with the user's head; and two lateral branches extending the central band at each of its ends, each of these branches comprising:

at a proximal end of the branch, an articulated connection with the respective end of the central band, this connection providing at least one pivotal degree of freedom about an axis perpendicular to the general plan of the headset;

at a distal end of the branch, a deformable connection with the respective earphone, so that the earphone form at the auditory canal respective second and third points of contact; and in a median region of the branch, the case housing the electric or electronic components, this case being provided, at an internal side of the headset, directed towards the user's head, with a bearing face adapted to come into contact with a temporal region of the headset user, so that the bearing faces form at the temples respective fourth and fifth points of contact.

2. The headset of claim 1, wherein said bearing face is a planar face provided with a soft trimming.

3. The headset of claim 1, wherein the central band is a flexible band, elastically deformable according to at least one flexural degree of freedom in the general plan of the headset.

4. The headset of claim 1, wherein said degree of freedom offered by the articulated connection of the branch to the central band has a sufficient angular displacement to allow a complete folding of the branch against the central band, with the branches and cases essentially located on a same side of a line joining the two articulated connections.

5. The headset of claim 4, wherein the case is located on the side of the most proximal part of the median region of the branch.

6. The headset of claim 1, wherein the case is a case that is distinct of said median region of the branch, and fastened to the latter on the internal side of the branch.

7. The headset of claim 1, wherein the branch further comprises a telescopic element for size adjustment, adapted to modify the distance separating the central band from the earphone.

8. The headset of claim 7, wherein said telescopic element for size adjustment is located near to said connection of the branch to the central band.

9. The headset of claim 1, wherein the articulated connection of the branch to the central band includes a spring clamping element, adapted to elastically push the branch towards the internal side of the headset, in a direction oriented towards the user's temple.

10. The headset of claim 1, further comprising at least one microphone incorporated to a branch in the median region thereof.

11. The headset of claim 1, further comprising at least one connector incorporated to a branch with a receptacle opening at the distal end of the branch, the axis of this receptacle being in the continuation of the general direction of the branch.

* * * * *